US005335727A

United States Patent [19]

Cornette et al.

[11] Patent Number: 5,335,727

[45] Date of Patent: Aug. 9, 1994

[54] FLUID LOSS CONTROL SYSTEM FOR GRAVEL PACK ASSEMBLY

[75] Inventors: H. Mitchell Cornette, Houston; John V. Salerni, Kingwood; Phillip W. Schmuck, New Waverly, all of Tex.

[73] Assignee: Atlantic Richfield Company, Los Angeles, Calif.

[21] Appl. No.: 971,494

[22] Filed: Nov. 4, 1992

[51] Int. Cl.[5] ..... E21B 43/08; E21B 43/10

[52] U.S. Cl. ..... 166/278; 166/387; 166/51; 166/120

[58] Field of Search ..... 166/51, 120, 278, 386, 166/387, 377

[56] References Cited

U.S. PATENT DOCUMENTS

| | | | |
|---|---|---|---|
| 3,913,675 | 10/1975 | Smyrl | 166/51 |
| 3,987,854 | 10/1976 | Callihan et al. | 166/278 |
| 3,997,006 | 12/1976 | Wetzel | 166/377 |
| 4,628,993 | 12/1986 | Zunkel | 166/278 X |
| 4,726,419 | 2/1988 | Zunkel | 166/278 X |
| 4,823,882 | 4/1989 | Stokley et al. | 166/387 |
| 4,856,591 | 8/1989 | Donovan et al. | 166/278 |
| 4,869,325 | 9/1989 | Halbardier | 166/357 |
| 5,036,920 | 8/1991 | Cornette et al. | 166/51 |

*Primary Examiner*—Ramon S. Britts
*Assistant Examiner*—Frank S. Tsay
*Attorney, Agent, or Firm*—Michael E. Martin

[57] ABSTRACT

An auger gravel pack assembly for installation in a gravel packed well includes a fluid loss control closure member retained in a body disposed in a tubing assembly or "work string" between the gravel pack screen and a running tool and cup-packer assembly. A ball-type closure member is retained by releasable fingers connected to a piston which is responsive to fluid pressure applied through the work string to effect release of the closure ball to engage a seat and substantially prevent flow of fluid from the work string or the wellbore annulus into and through the gravel pack screen after installation of the screen into the gravel pack. Ports in the assembly above the closure member allow fluid to flow between the wellbore annulus and the work string to prevent pressure buildup between the gravel pack and the cup-packer during installation of the screen.

15 Claims, 2 Drawing Sheets

FLUID LOSS CONTROL SYSTEM FOR GRAVEL PACK ASSEMBLY

BACKGROUND OF THE INVENTION

1. Field of the Invention

The present invention pertains to a releasable ball-type closure arrangement for an auger type gravel pack assembly for controlling fluid flow through the gravel pack assembly and into the gravel pack and the adjacent producing formation.

2. Background

In the installation of certain types of gravel pack assemblies, it is important to control the flow of fluid from the well, through the gravel pack and into the adjacent earth formation which is to be produced. The flow of wellbore fluid into the formation through the gravel pack can adversely contaminate the gravel pack as well as the formation. At the same time a limited flow of fluid in the direction indicated may be desirable in certain instances.

The control over fluid flow through a gravel pack and into the adjacent earth formation is particularly important when installing so-called auger-type gravel pack assemblies. This type of assembly is described in detail in U.S. Pat. No. 5,036,920 issued Aug. 6, 1991 to H. M. Cornette et al. and assigned to the assignee of the present invention. Certain improvements in fluid loss control systems for gravel pack assemblies are also described in U.S. patent application Ser. No. 07/877,924 filed: May 4, 1992 entitled Method and Apparatus for Gravel pack Completions by H. M. Cornette, Michael Johnson and Robert K. Bethel and also assigned to the assignee of the present invention. Basically, control over fluid flow through the gravel pack and into the formation from the wellbore is desired at all times during installation of the gravel pack assembly and connection of the production tubing string which normally follows such installation. Accordingly, it is important to be able to control the flow of fluid through the interior of the gravel pack assembly at a predetermined time while otherwise permitting some fluid flow before and during installation of the gravel pack assembly. In this regard the present invention provides an improved and unique fluid loss control apparatus which is adapted to be interposed in the gravel pack assembly, particularly an auger-type gravel assembly, during and upon completion of installation.

SUMMARY OF THE INVENTION

The present invention provides an improved gravel pack assembly which includes fluid loss control means operable, at will, to provide a closure to prevent fluid flow through a gravel pack screen and outwardly into a gravel pack or the earth formation which is to be produced of certain fluids. The present invention also provides an improved method of installing a gravel pack assembly, particularly an auger-type gravel pack assembly, wherein fluids are allowed to flow within the wellbore and into and through the gravel pack screen until, under predetermined conditions, a closure member is operated to block fluid flow outwardly through the gravel pack screen into the gravel pack.

In accordance with one important aspect of the present invention, an auger-type gravel pack assembly is provided with a closure seat and a closure member which is held in place off of the seat until, at a predetermined time, the closure member is released to engage the seat and to substantially prevent fluid flow through the tubing string connected to the gravel pack assembly and out through the gravel pack assembly and into the gravel pack. The closure member and seat arrangement may also be provided with suitable means to provide at least limited flow of fluid out through the gravel pack screen in the event of premature closure or in the event that a limited amount of fluid flow is desired during installation of the gravel pack assembly.

In accordance with another important aspect of the present invention, a gravel pack assembly is provided with a releasable closure member for operation to close off fluid flow within and out through the gravel pack screen. A ball type closure member is held off of its closure seat by a unique closure support and release mechanism which is operated, at will, by inserting in the tubing string another closure member which is engageable with the support and release mechanism to effect operation thereof.

Those skilled in the art will recognize the above-described features and advantages of the present invention together with other superior aspects thereof upon reading the detailed description which follows in conjunction with the drawing.

DESCRIPTION OF THE PREFERRED EMBODIMENTS

Figure 1:
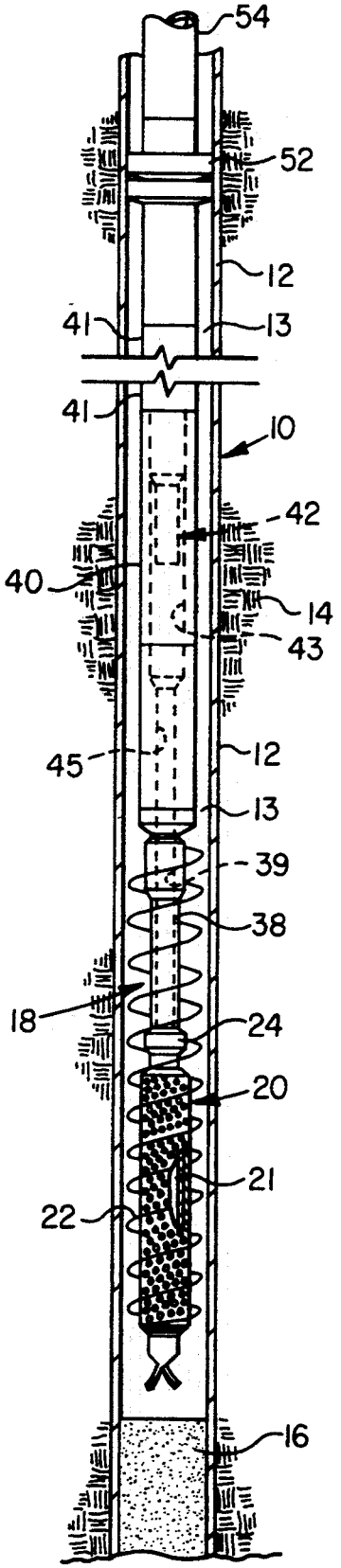
FIG. 1 is a vertical section view in somewhat schematic form of a cased well disposed in an earth formation and including the improved gravel pack assembly of the present invention.

In the description which follows, like parts are marked throughout the specification and drawing with the same reference numerals, respectively. The drawing figures are not necessarily to scale, and certain conventional elements familiar to those skilled in the art have been omitted in the interest of clarity and conciseness.

Referring to FIG. 1, there is illustrated a portion of a fluid-production well, generally designated by the numeral 10, including a casing 12 defining a wellbore 13 which is disposed in an earth formation 14. In the exemplary well 10 a gravel packing 16 has already been installed in the vicinity of a formation zone of interest through which fluids are to be produced. Only a small portion of the gravel packed part of the well 10 is illustrated. Also illustrated in FIG. 1 is an improved auger-type gravel pack assembly in accordance with the present invention and generally designated by the numeral 18. The gravel pack assembly 18 is shown in a position just above the gravel pack 16 which is where it would reside just prior to being "augered" into the gravel pack. The gravel pack assembly 18 includes an auger-type gravel pack screen member 20 and which may be of the type described in further detail in U.S. Pat. No. 5,036,920. Basically, the screen 20 includes a generally tubular body which includes means forming a tubular screen through which fluids may flow in either direction to or from an interior passage 21 but which is adapted to substantially prevent the flow of particulate matter, including the gravel from gravel pack 16, into the interior of the screen. The screen 20 is provided with one or more helical auger flights 22 formed on the periphery thereof also in accordance with the description in U.S. Pat. No. 5,036,920.

Figure 2:
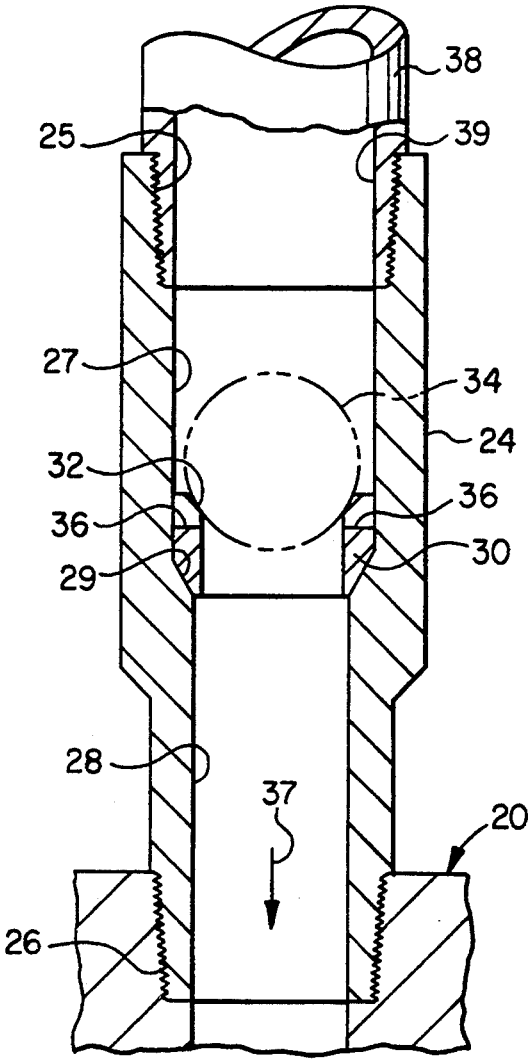
FIG. 2 is a detail central longitudinal section view of a sub interposed between the gravel pack screen and blank pipe portions of the gravel pack assembly and showing the closure seat member.

In the gravel pack assembly 18, the screen 20 is threadedly connected at its upper end to a sub 24 which may include a continuation of the auger flight 22 formed thereon. As shown in FIG. 2 , the sub 24 is a generally tubular member which is provided with a suitable threaded box portion 25 at its upper end and a pin portion 26 at its lower end for threadedly connecting the sub to the gravel pack assembly. The interior of the sub 24 includes a stepped bore 27, 28 forming a frustoconical shoulder 29 which supports a closure seat member 30, as illustrated. The seat member 30 includes a frustoconical seat surface 32 formed thereon for engaging a ball-type closure member 34, as illustrated. Opposed, radially-extending, narrow slots 36 are formed in the seat 30 to permit limited fluid flow past the closure member 34 in the direction indicated by the arrow 37 in FIG. 2.

Referring again to FIG. 1, the gravel pack assembly 18 may further include a so-called auger blank pipe section 38 or similar tubing section threadedly connected to the sub 24 at its lower end and also threadedly connected to a tubing section 40 at its upper end. The tubing section 40 is characterized by an elongated tube known in the art as a "hook-up nipple", which includes suitable means at its upper end for receiving a device known as a running tool 41, and is operable to be releasably connected to the running tool. The hook-up nipple/running tool assembly 40, 41 is, in turn, preferably connected to fluid seal means comprising a cup-type packer assembly 52. The assembly 52 is connected to a suitable tubing string, commonly known as a "work string" 54 which extends to the earth3 s surface, not shown. The hook-up nipple 40 and the so-called running tool 41 may each be of a type commercially available from Baker Sand Control, Division of Baker Hughes, Inc., Houston, Tex. The gravel pack screen 20 and blank pipe section 38 may also be commercially available from Baker Sand Control, as modified by the sub 24 interposed therebetween.

Figure 3:
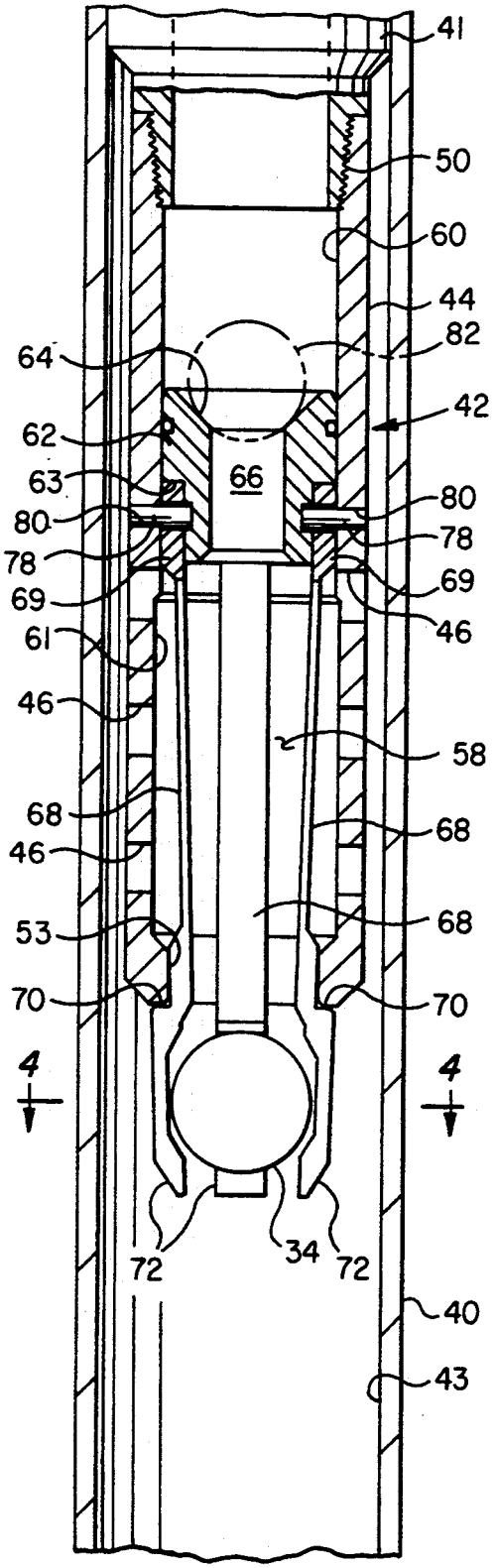
FIG. 3 is a central longitudinal section view of a ball type closure member support and release mechanism in the closure ball retaining condition.
Figure 5:
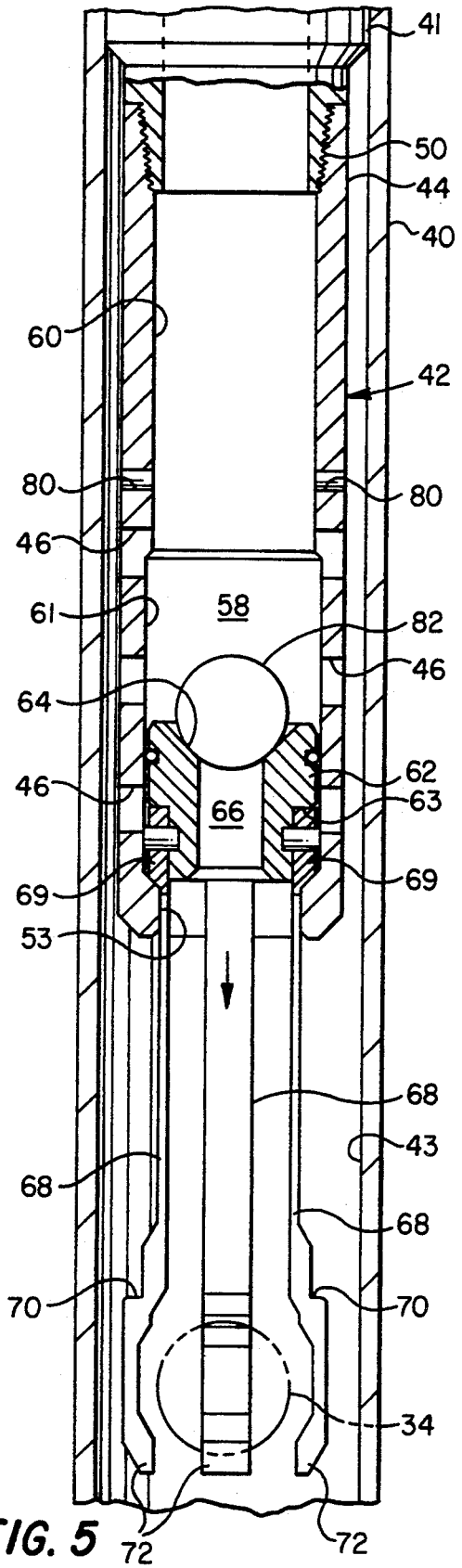
FIG. 5 is a view similar to FIG. 4 showing the closure ball support and release mechanism in the ball-released condition.

The running tool 41 is connected at its lower end to a unique ball closure support and release mechanism, generally designated by the numeral 42, and disposed in the interior passage 43 of the tubing section 40. As shown in FIGS. 3 and 5, the mechanism 42 includes a tubular body 44 having a plurality of fluid transfer ports 46 formed therein, as illustrated.

Figure 4:
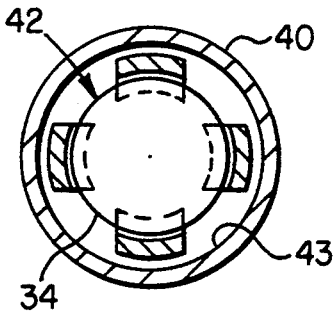
FIG. 4 is a section view taken along the line 4—4 of FIG. 3.

Referring further to FIGS. 3, 4, and 5, certain details of the ball closure member support and release mechanism 42 are illustrated. As shown in FIG. 3, the body 44 is suitably connected to the running tool 41 at its upper end 50. The ports 46 in the body 44 open into a passage 58 defined in part by a moderately stepped bore 60, 61 in which is also slidably disposed an annular piston and seat member 62. The member 62 includes a frustoconical ball seat surface 64 formed thereon and delimited by a central longitudinal passage 66.

The member 62 is suitably connected to four circumferentially spaced, axially-extending, elongated ball-retaining fingers 68 which include transverse shoulder portions 70 formed near their lower ends, as illustrated. The fingers 68 include distal end portions 72 for retaining the ball closure member 34 in the position shown in FIG. 3 when the fingers are confined radially inwardly as dictated by the diameter of a cylindrical bore portion 53 of the body 44. The tubing section 40 provides more radial clearance for the distal ends 72 of the ball-retaining fingers 68, so that the fingers may relax and move radially away from retention of the ball 34 and allow the ball to drop onto the seat 30, FIG. 2, when desired. The assembly of the member 62 and the ball-retaining fingers 68 is held in the position illustrated in FIG. 3 by a plurality of radially extending cylindrical shear pins 78 which are disposed in suitable pin bores 80 formed in the body 44. The pins 78 also extend into the member 62 and are used to retain the fingers 68 connected to member 62, as shown. The fingers 68 each include an end portion 69 nested in a slot 63 in the member 62.

When a closure ball 82 is put in position in engagement with the seat 64, fluid in the bore 60 acting against the closure ball 82 and the member 62 will, at a predetermined pressure, effect shearing of the pins 78 and subsequent movement of the member 62 and the fingers 68 to the position shown in FIG. 5 whereupon the ball 34 will be released for movement into engagement with the seat 30. The ball 82 may be prepositioned in engagement with the seat surface 64 at any time during the installation of the gravel pack assembly 18 by dropping the ball down through the tubing string 54, the cup-packer assembly 52 and the running tool 41. Either before or after movement of the member 62 and the closure ball 82 to the position shown in FIG. 5, at least some of the ports 46 are in communication with the tubing string 54 above the member 62 and the wellbore 13 above the gravel pack 16 by way of the passage 21, the bore 28, an interior passage 39 of the pipe section 38 and the passage 43. In this way, as the auger gravel pack assembly 18 is installed in the gravel pack 16 by rotatably augering into the gravel pack, fluid in the wellbore 13 between the gravel pack 16 and the cup-packer assembly 52 may flow into the tubing string through at least some of the ports 46 to substantially relieve hydrostatic pressure as the volume of the wellbore portion 13 between the gravel pack and the packer-cups is reduced. Alternatively, a ported tubing section or "sub", not shown, might be installed in the assembly between the pipe section 38 and sub 24 or the tubing section 40 to conduct wellbore fluids between the wellbore and the tubing string 54.

A typical installation procedure for the gravel pack assembly 18 will now be described. When it is desired to install the gravel pack assembly 18, it is lowered on the work string 54 together with the other components illustrated in FIG. 1 until the gravel pack assembly is just above the pre-installed gravel pack 16. During lowering of the tubing string 54 with the gravel pack assembly 18 connected thereto, the closure ball 34 is retained by the support and release mechanism 42 in the position shown in FIG. 3. The closure ball 82 may already be in position in engagement with the seat surface 64 or may be dropped through the tubing string 54 when desired. If a fluid column is present in the wellbore above the cup-packer assembly 52, at a pressure which is greater than the formation pressure at the gravel pack 16, substantial fluid flow will be prevented by the cup-packer assembly. Moreover, substantial fluid flow down through the tubing string 54 and the gravel pack assembly 18 is also prevented by the presence of the closure ball 82 in engagement with the seat surface 64. The shear pins 78 are determined to be such as to not shear under the mere weight of the fluid column in the tubing string 54 but only upon increasing the fluid pressure a predetermined amount by pumping fluid into the tubing string in a conventional manner, for example.

Either during or, preferably, after the gravel pack assembly 18 is augered into the gravel pack 16, fluid pressure is applied through the tubing string 54 to act on the closure member 82 and the member 62 to shear the pins 78 and effect downward movement of the ball-release fingers 68 to the position shown in FIG. 5 whereby the ball 34 may then drop to engage the seat 30 and prevent any significant fluid flow from the interior passage 21 of the gravel pack screen 20 out into the gravel pack 16. The running tool 41 and the mechanism 42, minus the closure member 34, may then be retrieved from the wellbore and further operations, such as installation of a completion string, not shown, may be carried out.

Moreover, if it is desired to allow some circulation of fluid through the tubing string 54 and the gravel pack assembly 18 during installation, or if the ball 34 is prematurely or inadvertently released, at least very limited fluid flow past the ball 34 and into the interior of the screen 20 may be permitted to occur through the slots 36. If the ball 34 has not been released and the ball 82 has not been disposed on the seat 64, fluid may be allowed to flow between the tubing string 54 and the wellbore 13, at will. Accordingly, an improved fluid loss control assembly for and a method of installation of a gravel pack assembly, particularly an auger-type gravel pack assembly, is provided by the present invention.

The components of the gravel pack assembly 18 may be constructed using conventional engineering materials known to those skilled in the art of wellbore tools and installation methods. The ball 34, in particular, or the seat 36, may be made of a frangible material which may be dissolved or pulverized in response to treatment with certain fluids or excessive hydrostatic pressure. One material which would be suitable is a ball closure member sold under the trademark Bakelite by Baker Sand Control. The ball closure member 34 or the seat 36 may also be formed of an easily removed metal such as aluminum.

Although preferred embodiments of the present invention have been described in detail herein, those skilled in the art will recognize that various substitutions and modifications may be made without departing from the scope and spirit of the invention recited in the appended claims.

What is claimed is:

1. In an auger gravel pack assembly including an auger gravel pack screen and a tubing assembly defining a flow passage for fluids to flow through said screen between a gravel pack and said tubing assembly, the improvement comprising:

means forming a closure seat interposed in said gravel pack assembly;

a first closure member in said gravel pack assembly between said tubing string and said screen for movement to engage said closure seat to substantially prevent unwanted fluid flow through said screen and into said gravel pack; and means operable to cause said closure member to engage said closure seat comprising support means for said closure member including a member responsive to fluid pressure acting thereon for causing said support means to release said closure member for movement to engagement with said closure seat.

2. The improvement set forth in claim 1 wherein:

said support means comprises a plurality of elastically deflectable retaining fingers for retaining said first closure member in a first position and movable to a second position to release said first closure member.

3. A closure member support and release mechanism adapted to be interposed in a gravel pack assembly disposed in a wellbore between an auger gravel pack screen and a work string, said mechanism comprising:

a generally elongated tubular body including at least one port in said body communicating an interior passage in said body with the exterior of said body;

a generally annular piston disposed in said body and connected to a plurality of axially extending closure member support fingers disposed in said body;

frangible means for retaining said piston and said fingers in a first position in said body for retaining a closure member supported by said fingers; and means associated with said piston operable to effect a pressure fluid force acting on said piston to move said piston from a first position to a second position in response to failure of said frangible means to release said closure member for movement to a position to prevent fluid flow from said passage into the interior of said auger gravel pack screen.

4. A method for installing an auger-type gravel-pack assembly into a gravel pack formed in a wellbore comprising the steps of:

providing a gravel pack assembly including an auger gravel pack screen, closure means disposed in a body connected to said gravel pack screen and a tubing string for lowering the gravel pack screen into said wellbore, said body including port means operable to be in communication with the interior of said body and said wellbore;

providing seal means interposed in said tubing string between the earth's surface and said gravel pack to substantially prevent a fluid column in said wellbore from acting on said gravel pack;

lowering said gravel pack assembly into said wellbore on said tubing string while permitting fluid flow between said wellbore and said tubing string through said gravel pack assembly; and causing said closure means to substantially prevent fluid flow through at least part of said tubing string and said gravel pack screen and into said gravel pack.

5. The method set forth in claim 4 including the step of:

retrieving at least part of said tubing string and said body from said wellbore.

6. A method for installing an auger-type gravel pack assembly into a gravel pack formed in a wellbore comprising the steps of:

providing a gravel pack assembly including an auger gravel pack screen, a seat for a closure member, a closure member retained in a body connected to said gravel pack screen and a tubing string for lowering the gravel pack screen into said wellbore, said body including port means in communication with the interior of said body and said wellbore;

providing seal means interposed in said tubing string between the earth's surface and said gravel pack to substantially prevent a fluid column in said wellbore from acting on said gravel pack;

lowering said gravel pack assembly into said wellbore on said tubing string while permitting fluid flow between said wellbore and said tubing string and said gravel pack assembly; and causing said closure member to engage said seat to substantially prevent fluid flow through the interior of said gravel pack screen and into said gravel pack.

7. The method set forth in claim 6 including the step of:

dropping a closure ball through said tubing string for engagement with means on said body for causing said closure member to engage said seat.

8. In an auger gravel pack assembly including an auger gravel pack screen and a tubing assembly defining a flow passage for fluids to flow through said screen between a gravel pack and said tubing assembly, the improvement comprising:

means forming a first closure seat interposed in said gravel pack assembly;

a first closure member in said gravel pack assembly between said tubing string and said screen for movement to engage said first closure seat to substantially prevent unwanted fluid flow through said screen and into said gravel pack; and means operable to cause said first closure member to engage said first closure seat comprising support means for said first closure member including a second closure member retained on a second closure seat and responsive to fluid pressure acting thereon to effect movement of said support means to release said first closure member for movement to engagement with said first closure seat.

9. In an auger gravel pack assembly including an auger gravel pack screen and a tubing string defining a flow passage for fluids to flow through said screen between a gravel pack and said tubing string, the improvement comprising:

means forming a first closure seat interposed in said gravel pack assembly;

a first closure member in said gravel pack assembly between said tubing string and said screen for movement to engage said first closure seat to substantially prevent unwanted fluid flow through said screen and into said gravel pack;

means operable to cause said first closure member to engage said first closure seat including support means including a member responsive to fluid pressure acting thereon for causing said support means to release said first closure member for movement to engagement with said first closure seat; and said member responsive to fluid pressure acting thereon is disposed in a body operably connected to said screen, said body including ports formed therein to provide for communication of fluid between a wellbore and said tubing string during installation of said gravel pack assembly in said wellbore.

10. The improvement set forth in claim 9 wherein:

said gravel pack assembly includes seal means to prevent a fluid column in part of said wellbore from acting on said gravel pack assembly and said gravel pack during installation of said gravel pack assembly in said wellbore.

11. In an auger gravel pack assembly for insertion in a gravel pack in a wellbore including an auger gravel pack screen and a tubing string defining a flow passage for fluids to flow from said gravel pack screen, the improvement comprising:

a seat interposed in said gravel pack assembly;

a closure member engageable with said seat to substantially prevent fluid flow from said tubing string through said gravel pack screen and into a gravel pack; and a closure support member interposed between said gravel pack screen and said tubing string including a piston and a plurality of closure retaining fingers connected to said piston for supporting and retaining said closure member in a first position of said piston, said piston including at least one shear pin for connecting said piston to a support body for said piston in said first position, said shear pin being responsive to a predetermined pressure force in said tubing string and acting on said piston to release said piston and said fingers to move to a second position to release said closure member from said fingers to engage said seat to substantially prevent fluid flow from said tubing string to said gravel pack screen.

12. The improvement set forth in claim 11 wherein:

said piston includes a passage formed therein and a closure member seat formed thereon for receiving a second closure member to engage said closure member seat and to provide for increasing the fluid pressure acting on said piston to move from said first position to said second position.

13. In an auger gravel pack assembly for insertion in a gravel pack in a wellbore including an auger gravel pack screen and a tubing assembly defining a flow passage for fluids to flow from said gravel pack screen, the improvement comprising:

a seat interposed in said gravel pack assembly;

a closure member engageable with said seat to substantially prevent fluid flow from said tubing assembly through said gravel pack screen and into a gravel pack;

a closure support member interposed between said gravel pack screen and said tubing assembly including a piston and a plurality of closure retaining fingers connected to said piston for supporting and retaining said closure member in a first position of said piston, said piston being operable in response to a predetermined fluid pressure in said tubing assembly to effect release of said closure member from said fingers to engage said seat to substantially prevent fluid flow from said tubing assembly to said gravel pack screen; and said seat includes fluid bypass passages formed therein to permit limited fluid flow past said seat into said gravel pack screen when said closure member engages said seat.

14. In an auger gravel pack assembly for insertion in a gravel pack in a wellbore including an auger gravel pack screen and a tubing assembly defining a flow passage for fluids to flow from said gravel pack screen, the improvement comprising:

a seat interposed in said gravel pack assembly;

a closure member engageable with said seat to substantially prevent fluid flow from said tubing assembly through said gravel pack screen and into a gravel pack, said closure member being formed of at least one of a frangible material and a material dissolvable by fluid injected into said tubing assembly; and a closure support member interposed between said gravel pack screen and said tubing assembly including a piston and a plurality of closure retaining fingers connected to said piston for supporting and retaining said closure member in a first position of said piston, said piston being operable in response to a predetermined fluid pressure in said tubing assembly to effect release of said closure member from said fingers to engage said seat to substantially prevent fluid flow from said tubing assembly to said gravel pack screen.

15. In an auger gravel pack assembly for insertion in a gravel pack in a wellbore including an auger gravel pack screen and a tubing assembly defining a flow passage for fluids to flow from said screen, the improvement comprising:

a seat interposed in said gravel pack assembly, said seat being formed of at least one of a frangible material and a material dissolvable by fluid injected into said tubing assembly;

a closure member engageable with said seat to substantially prevent fluid flow from said tubing assembly through said screen and into a gravel pack;

a closure support member interposed between said gravel pack screen and said tubing assembly including a piston and a plurality of closure retaining fingers connected to said piston for supporting and retaining said closure member in a first position of said piston, said piston being operable in response to a predetermined fluid pressure in said tubing assembly to effect release of said closure member from said fingers to engage said seat to substantially prevent fluid flow from said tubing assembly to said screen.

* * * * *